US008230644B2

(12) United States Patent
Lambertini

(10) Patent No.: US 8,230,644 B2
(45) Date of Patent: Jul. 31, 2012

(54) HINGE UNIT FOR HOPPER/AWNING WINDOW UNITS

(75) Inventor: Marco Lambertini, San Lazzaro di Savena (IT)

(73) Assignee: GSG International S.p.A., Budrio (IT)

( * ) Notice: Subject to any disclaimer, the term of this patent is extended or adjusted under 35 U.S.C. 154(b) by 277 days.

(21) Appl. No.: 12/516,287

(22) PCT Filed: Nov. 15, 2007

(86) PCT No.: PCT/IB2007/003649

§ 371 (c)(1),
(2), (4) Date: May 26, 2009

(87) PCT Pub. No.: WO2008/065510

PCT Pub. Date: Jun. 5, 2008

(65) Prior Publication Data

US 2010/0058667 A1 Mar. 11, 2010

(30) Foreign Application Priority Data

Nov. 28, 2006 (IT) ..... BO2006A0809

(51) Int. Cl.
*E05D 15/30* (2006.01)

(52) U.S. Cl. ..... 49/250; 49/251; 49/252; 49/246; 49/248; 49/247

(58) Field of Classification Search ..... 49/208, 49/246–253
See application file for complete search history.

(56) References Cited

U.S. PATENT DOCUMENTS 2,688,779 A * 9/1954 Westman ..... 49/252
4,364,201 A * 12/1982 Taylor ..... 49/248
4,689,852 A * 9/1987 Buckley ..... 16/341
4,718,144 A * 1/1988 Buckley ..... 16/341
4,790,106 A * 12/1988 La See ..... 49/252
4,833,754 A * 5/1989 Yang ..... 16/339
4,930,185 A * 6/1990 Hutton ..... 16/325
4,986,028 A * 1/1991 Schneider et al. ..... 49/248
5,074,075 A * 12/1991 La See ..... 49/252
5,081,743 A * 1/1992 Mayes ..... 16/341
5,083,344 A * 1/1992 Pettit et al. ..... 16/254
5,255,471 A * 10/1993 Shaw et al. ..... 49/252
RE34,657 E * 7/1994 La See ..... 49/252
RE35,635 E * 10/1997 Bauman ..... 16/239

(Continued)

FOREIGN PATENT DOCUMENTS

FR 2685379 A 6/1993

(Continued)

*Primary Examiner* — Katherine W Mitchell
*Assistant Examiner* — Marcus Menezes
(74) *Attorney, Agent, or Firm* — Pearne & Gordon LLP

(57) ABSTRACT

A hinge unit for hopper/awning window units (1), the window unit comprising a fixed frame (2) and a sash (3) capable of rototranslation between open and closed positions. The hinge units (4) each comprise: a supporting element (5) integral with the fixed frame (2); an arm (6) one end of which pivots at the sash (3); a first slide (7) slidable along the supporting element (5); connecting rods (8, 9) connecting the first slide (7) to the arm (6); a joint rod (10) between the arm (6) and the supporting element (5), its ends respectively pivoting at a distal point of the supporting element (5) and at the arm (6), so as to form a second connecting point (F2); there being adjusting means (11) to allow a variation of the connecting point (F2) along the supporting element (5).

6 Claims, 3 Drawing Sheets

U.S. PATENT DOCUMENTS

| | | | | | |
|---|---|---|---|---|---|
| 5,794,310 | A * | 8/1998 | Dallmann | 16/362 |
| 5,964,011 | A * | 10/1999 | Ruston et al. | 16/239 |
| 6,434,887 | B2 * | 8/2002 | Nakanishi et al. | 49/246 |
| 6,643,896 | B2 * | 11/2003 | Carrier | 16/242 |
| 2007/0101653 | A1 * | 5/2007 | Bruzek et al. | 49/246 |

FOREIGN PATENT DOCUMENTS

| | | | |
|---|---|---|---|
| GB | 2273314 | A * | 6/1994 |
| GB | 2278398 | A * | 11/1994 |
| GB | 2323123 | A | 9/1998 |
| GB | 2333123 | A | 7/1999 |

* cited by examiner

HINGE UNIT FOR HOPPER/AWNING WINDOW UNITS

TECHNICAL FIELD

The present invention relates to a hinge unit for hopper/awning window units, that is to say, window units which open with "rototranslation" of the sash relative to the fixed frame towards the outside/inside of the fixed frame.

BACKGROUND ART

The above-mentioned type of window unit, widely known, is used above all on large curtain walls for ventilating rooms, for example, but without limiting its scope, on high-rise buildings with extensive use of glazing.

The sash can be moved from a closed position, in which it is in contact with the fixed frame, to an open position in which the sash is slidably rotated, away from the fixed frame, until it is able to reach, where required, a position almost at a right angle to the previous one, and vice versa.

For this type of movement, inserted between the fixed frame and the sash on both sides (that is to say, on two opposite sides), there is a pair of hinge units, each comprising:

- a supporting and guiding element integral with the fixed frame;
- an arm, one end of which is connected to the sash;
- jointed connecting elements inserted between the supporting element and the sash supporting arm, designed to allow the arm to move between the closed position and the open position, and vice versa.

In particular, these connecting elements usually comprise: a slide which is slidably positioned along the supporting element (forming a connecting point which, for the sake of simplicity, will be referred to as the movable pivot);

- a plurality of connecting rods between the slide and the arm, designed to form at least one four-bar linkage, to allow rototranslation of the arm away from and towards the supporting element;
- a joint rod between the arm and the element, one end of the rod pivoting at a fixed point of the supporting element (forming a second connecting point, referred to as the lower connecting point).

Moreover, the supporting and guiding element has a proximal end shaped to form a sort of "roof-style" cover (symmetrical or asymmetrical) in which the upper end of the joint arm is positioned when the sash is in the closed position.

To improve the window unit seal, the end of the arm is usually equipped with an insert shaped to match the configuration of the cover, allowing an interference fit to achieve optimum locking and seal between the sash and the fixed frame.

Said hinge units are widely used and it has been shown that the most delicate or critical zone of these units is that of contact between the upper end of the arm and the supporting element proximal upper covering end, in the closed configuration.

This zone is designed so that, at the end of the sash closing movement, it forms the point of contact between the arm and the supporting element, then is compressed (in particular the end of the arm) during sash closing to give stable closing and a weatherproof seal.

It is therefore obvious that, over time, this point is subjected to significant stresses due precisely to the purpose for which it is intended, that is to say, to stabilise window unit closing (by rubbing contact of the cover with the insert) and to maintain a good weatherproof seal when the window unit is closed.

For this reason, as well as the presence of the insert (usually made of plastic material) at present, the asymmetrical cover element configuration is preferred, because the presence of a longer contact side allows a force to be discharged on this (more extensive) upper angled surface than with a symmetrical configuration: this allows greater stability and an improved seal in the closed configuration, also reducing the hinge unit stress from wear.

However, despite this, the hinge unit structured in this way may have several disadvantages due to the limited flexibility of joint system adjustments both during the assembly step and during hinge unit use: this inflexibility, above all regarding the upper contact zone, may cause incorrect contacts between the parts and, above all, a failure of the weatherproof seal.

DISCLOSURE OF THE INVENTION

The present invention therefore has for an aim to overcome these disadvantages by providing a hinge unit for hopper/awning window units that is very flexible in terms of adjustment of the fixed—movable parts in contact, both during the assembly step and during hinge unit use, but still maintaining the excellent structural and functional features of conventional hinge units.

Accordingly, the present invention achieves this aim with a hinge unit, in particular a hinge unit for hopper/awning windows comprising the technical features set out in one or more of the claims herein.

BRIEF DESCRIPTION OF THE DRAWINGS

The technical features of the invention, with reference to the above aims, are clearly described in the claims below and its advantages are apparent from the detailed description which follows, with reference to the accompanying drawings which illustrate a preferred embodiment of the invention provided merely by way of example without restricting the scope of the inventive concept, and in which:

DETAILED DESCRIPTION OF THE PREFERRED EMBODIMENTS OF THE INVENTION

Figure 1:
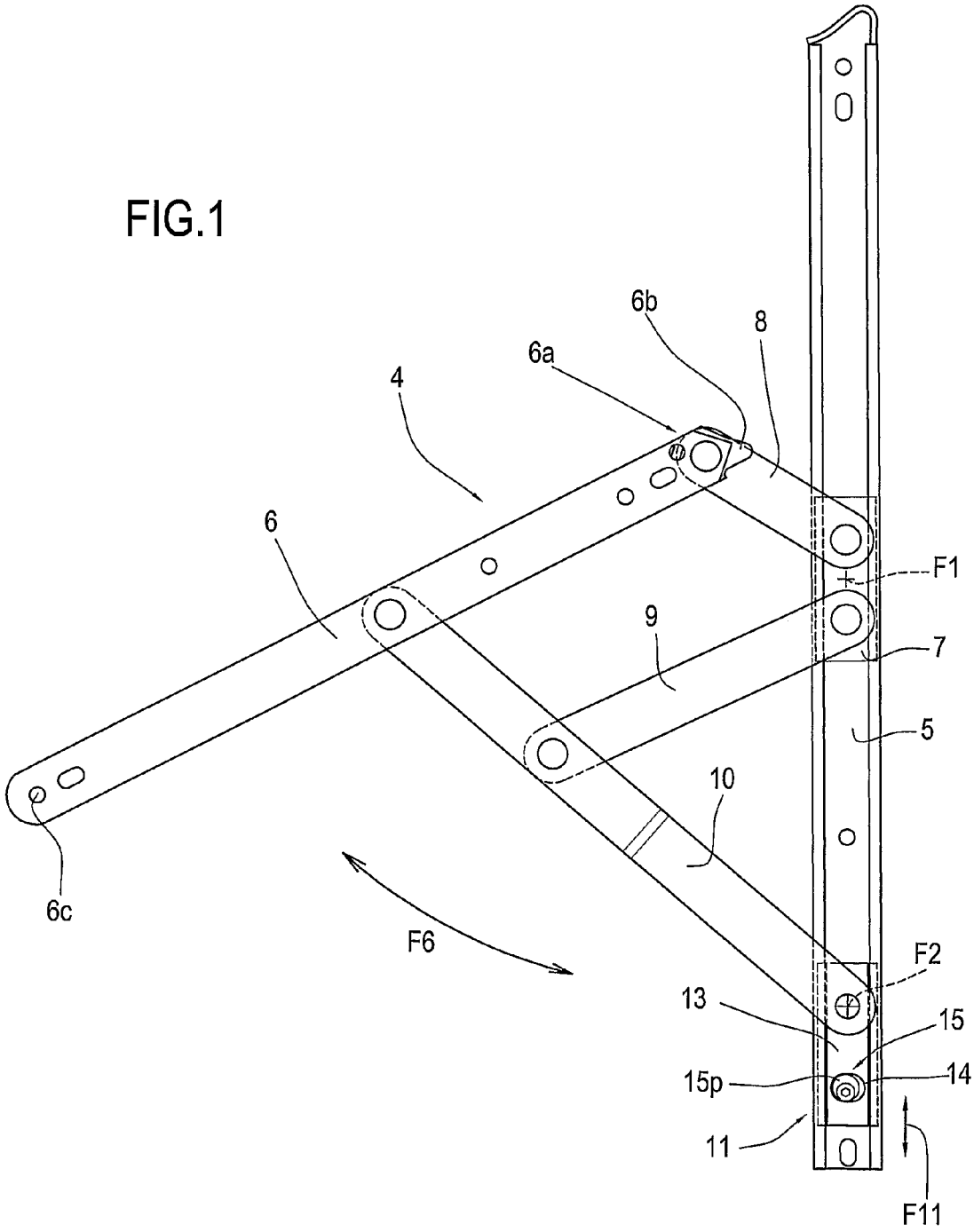
FIG. 1 is a side view with some parts cut away in order to better illustrate others, of a hinge unit made in accordance with the present invention.
Figure 2:
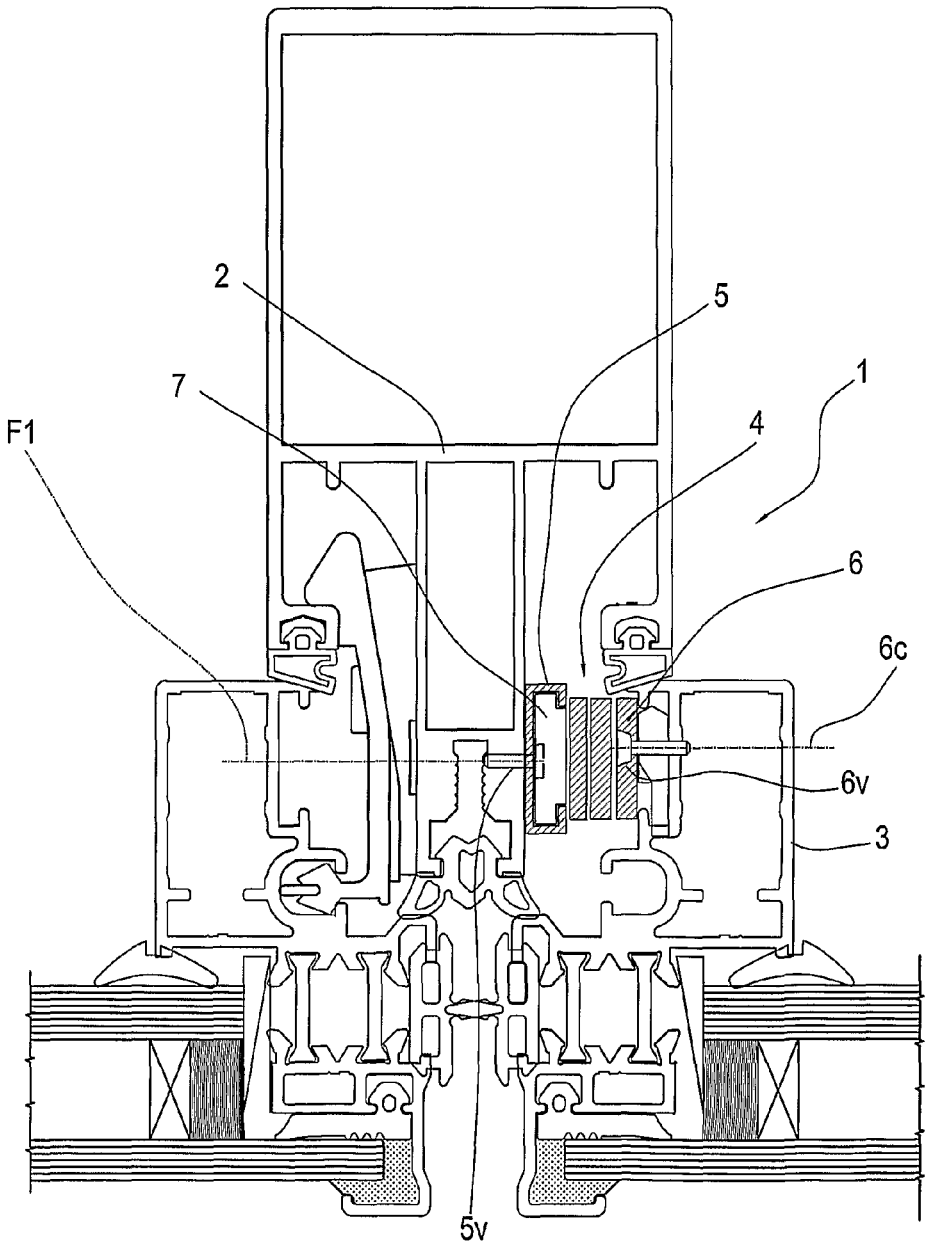
FIG. 2 is a cross-section with some parts cut away to better illustrate others, of part of a window unit to which the hinge unit of FIG. 1 is applied.

With reference to the accompanying drawings, in particular FIGS. 1 and 2, the numeral 4 denotes as a whole the hinge unit according to the invention which is used to move hopper/awning window units 1.

These window units 1 comprise a fixed frame 2 and a sash 3 capable of rototranslation about/along at least a first connecting point F1 movable between a window unit 1 closed position (hinge unit 4 configuration visible in FIGS. 3 to 5) and an open position (hinge unit 4 configuration visible in FIG. 1 and arrows F6).

Inserted between the fixed frame 2 and the sash 3, on both sides, is a pair of the hinge units 4, each comprising: a supporting and guiding element 5; an arm 6; a first slide 7, connecting rod means 8, 9 and a joint rod 10.

More precisely, the supporting and guiding element 5 is integral (thanks to screw means 5*v*) with the fixed frame 2 and forms, in the case illustrated and purely by way of example, a guiding upright for the other elements of the hinge unit 4.

Obviously, the hinge units 4 can also be mounted horizontally on the fixed frame 2, allowing the sash 3 to be "side-hung" and opened by turning outwards.

One end of the arm 6 pivots at the sash 3, at 6*c* (thanks to relative means 6*v*) and forms the actual connecting element between the fixed frame 2 and the sash 3.

Moreover, the supporting element 5 has, on its upper or proximal end, a cover element 12 which is tapered and projects, designed to make contact with the upper end 6*a*, shaped to match it, of the arm 6 when the sash 3 is in the closed position, to allow the sash 3 to be held stably in the closed position.

The first slide 7 is slidably connected along the supporting element 5 and forms the above-mentioned first connecting point F1.

The connecting rod means 8 and 9 are actual connecting rods 8 and 9 and two are shown by way of example only, since there are many possible geometric configurations of these linkages, without limiting the solution disclosed.

These two connecting rods 8 and 9 respectively connect the first slide 7 to the arm 6 and the first slide 7 to the rod 10, forming a sort of four-bar linkage, to allow rototranslation of the arm 6 away from and towards the supporting element 5.

In particular, the upper connecting rod 8 pivots and is inserted between the upper end of the arm 6 and the slide 7, whilst the lower connecting rod 9 pivots and is inserted between the slide 7 and an intermediate point of the rod 10.

The ends of this joint rod 10 between the arm 6 and the supporting element 5 pivot respectively at a lower or distal point of the supporting element 5 and at the arm 6, thus forming a second hinge unit 4 connecting point F2 (for the sake of simplicity referred to as the lower connecting point).

The numeral 11 denotes adjusting means present on each hinge unit 4 and inserted between the joint rod 10 and the supporting element 5 to allow a variation, in both directions (see arrows F11 in FIGS. 1 and 3 to 5), of the second, lower connecting point F2 along the supporting element 5.

More specifically, these adjusting means 11 are inserted between the joint rod 10 and the supporting element 5 in such a way as to vary, in both directions, the distance D of the lower connecting point F2 from the proximal upper end of the supporting element 5, that is to say, from the cover element 12, and so obtain a variation of the opposing force between the respective ends of the arm 6 and the supporting element 5 in the closed position.

In particular, these adjusting means 11 are connected to the supporting element 5 and have a second connecting point F2 on which the end of the rod 11 jointed, in practice forming the lower connecting point.

At structural level, these adjusting means 11 comprise a second slide 13 positioned along the supporting element 5 and having a through-hole 14 housing operating and connecting elements 15.

These operating and connecting elements 15 can be rotatably associated with the supporting element 5 and act on the second slide 13, allowing adjusting sliding along the supporting element 5 (see arrows F15).

The end of the rod 10 pivots at F2 in a zone adjacent to the through-hole 14.

The operating and connecting elements 15 (FIGS. 3 to 5) comprise a pin 15*p* rotatably connected to the supporting element 5 (for example by caulking) and positioned in the through-hole 14. Obviously, the pin 15*p* can be rotated by an operator using a tool, such as an Allen key, to allow the above-mentioned adjustment.

Figure 3:
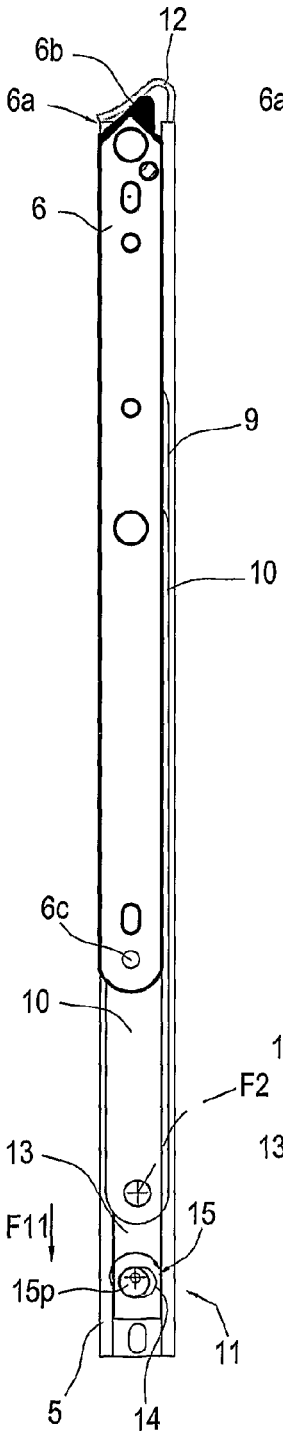
FIGS. 3, 4 and 5 are all side views with some parts cut away to better illustrate others, of the hinge unit in accordance with the invention in respective configurations which can be achieved in a closed position.
Figure 4:
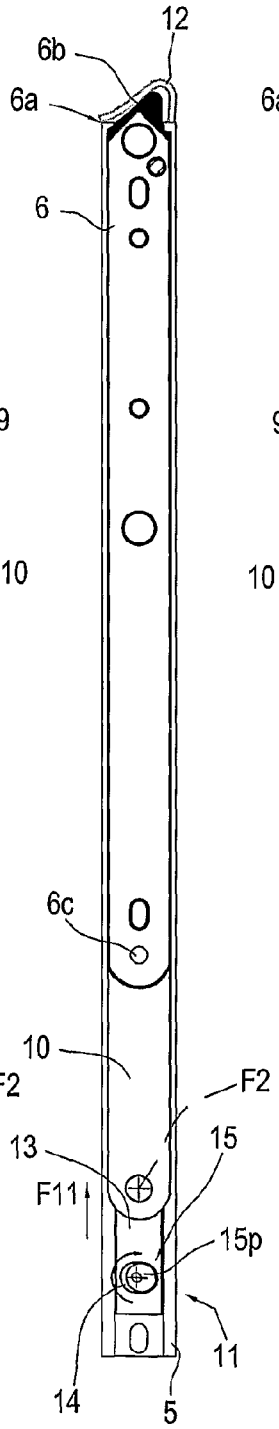
Figure 5:
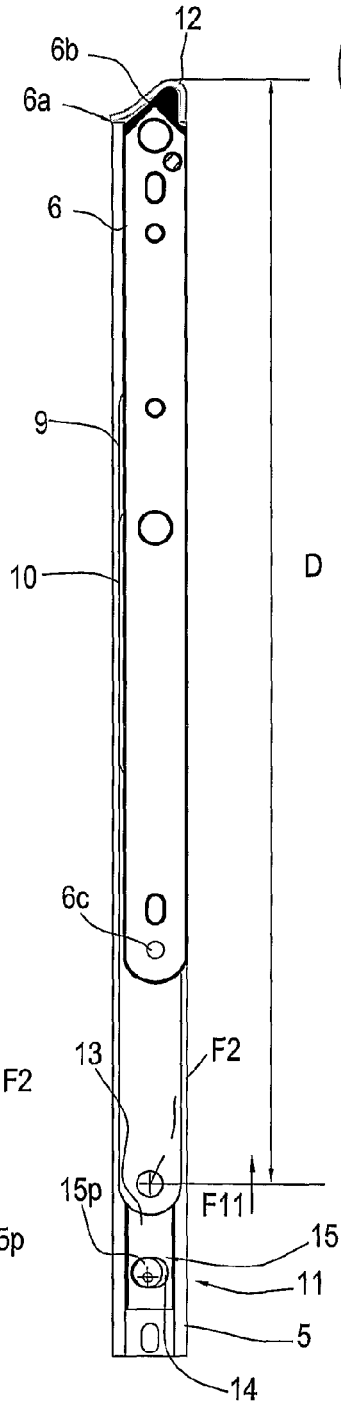

The hole 14 has an ellipsoid cross-section, allowing a cam-style movement of the second slide 13 only parallel with the supporting element 5 when the pin 15*p* is rotated for adjustment purposes, as is clearly shown in the three positions in FIGS. 3, 4 and 5.

Figure 6:
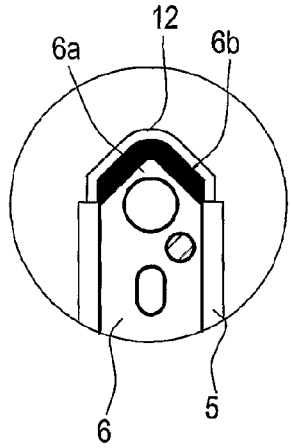
FIG. 6 is a partial side view of an alternative embodiment of the proximal upper end of a hinge unit as illustrated in the previous figures.

As can clearly be seen in FIG. 6, the above-mentioned cover element 12 present on the shaped end of the supporting element 5 and the upper end 6*a* of the arm 6 can each have a tapered configuration with symmetrical sides, that is to say, they are pointed.

Alternatively, as shown in FIGS. 2 and 3 to 5, the cover element 12 and the upper end 6*a* of the arm 6 may each have a tapered configuration with asymmetrical sides.

In both embodiments, without limiting the scope of the present invention, the upper end 6*a* of the arm 6 may have an insert 6*b* applied on the end and shaped to match the cover element 12 of the supporting element 5, thus allowing greater stability in the window unit 1 closed configuration. Basically, the possibility of adjusting the lower connecting point F2 allows the installer, both during installation and during use, to simply and easily adjust the compression force to be applied between the upper end of the arm and the cover element, according to the current requirements: greater tolerances during assembly, play to be taken up, plastic insert wear or small deformations of the contact zones.

Therefore, at structural level, this possibility has a minimal effect on the reliable hinge unit structures present, but extends and improves the operating possibilities of the hinge unit with consequent increases in the quality of the accessory and its operating lifetime.

It will be understood that the invention described is susceptible of industrial application and may be modified and adapted in several ways without thereby departing from the scope of the inventive concept. Moreover, all the details of the invention may be substituted by technically equivalent elements.

The invention claimed is:

1. A hinge unit for window units (1), the window units (1) comprising a fixed frame (2) and a sash (3) capable of rotation and translation between a window unit (1) closed position and an open position; a hinge unit (4) being inserted on each opposite side of the window unit between the fixed frame (2) and the sash (3), each hinge unit (4) comprising at least:

a supporting element (5) integral with the fixed frame (2) and having an upper end;

an arm (6), one end of which pivots at the sash (3);

a first slide (7) slidably positioned along the supporting element (5) and forming a movable connecting point (F1);

connecting rod means (8, 9) for connecting the first slide (7) to the arm (6), being designed to allow rotation and translation of the arm (6) away from and towards the supporting element (5);

a joint rod (10) pivotally connected to the arm (6) and pivotally connected to a second slide (13) which is slidable along the supporting element (5), wherein a pin is attached to and extends from the supporting element (5), the pin having a cam wheel which is located in a through-hole (14) in the second slide (13), the cam wheel being rotatable within the through-hole so that, when the cam wheel is rotated from a first position to a second position, the second slide (13) is moved towards the upper end of the supporting element (5), and when the cam wheel is rotated from the second position to a third position, the second slide (13) is moved away from the upper end of the supporting element (5).

2. The hinge unit according to claim 1, where the upper end of the supporting element (5) has a tapered and projecting cover element (12), designed to make contact with an upper end (6*a*), and shaped to match the upper end, of the arm (6) when the sash (3) is in the closed position, allowing the sash (3) to be held stably in the closed position.

3. The hinge unit according to claim 2, characterized in that the cover element (12) and the upper end (6*a*) of the arm (6) each have a tapered configuration with symmetrical sides.

4. The hinge unit according to claim 2, characterized in that the cover element (12) and the upper end (6*a*) of the arm (6) each have a tapered configuration with asymmetrical sides.

5. The hinge unit according to claim 3, characterized in that the upper end (6*a*) of the arm (6) has an insert (6*b*) applied on the end and shaped to match the cover element (12).

6. The hinge unit according to claim 4, characterized in that the upper end (6*a*) of the arm (6) has an insert (6*b*) applied on the end and shaped to match the cover element (12).

* * * * *